United States Patent [19]

Klinkert

[11] 4,161,671

[45] Jul. 17, 1979

[54] X-RAY TUBE

[75] Inventor: Gerardus F. Klinkert, Waddinxveen, Netherlands

[73] Assignee: B.V. Neratoom, The Hague, Netherlands

[21] Appl. No.: 886,444

[22] Filed: Mar. 14, 1978

[30] Foreign Application Priority Data

Mar. 14, 1977 [NL] Netherlands ..... 7702720

[51] Int. Cl.[2] ..... H01J 35/10

[52] U.S. Cl. ..... 313/60; 313/149

[58] Field of Search ..... 313/60, 149

[56] References Cited

U.S. PATENT DOCUMENTS 2,499,545 3/1950 Van Der Tuuk et al. ..... 313/60 X

*Primary Examiner*—James B. Mullins

*Assistant Examiner*—Darwin R. Hostetter

[57] ABSTRACT

An X-ray tube having a cathode serving as a source of electron rays and a rotatable anode, with which for example a tube-to-tube weld connection can be tested throughout without changing the position of the tube. For that purpose the anode of the tube is bevelled so that a rotating X-ray beam can be obtained by rotating the anode.

1 Claim, 1 Drawing Figure

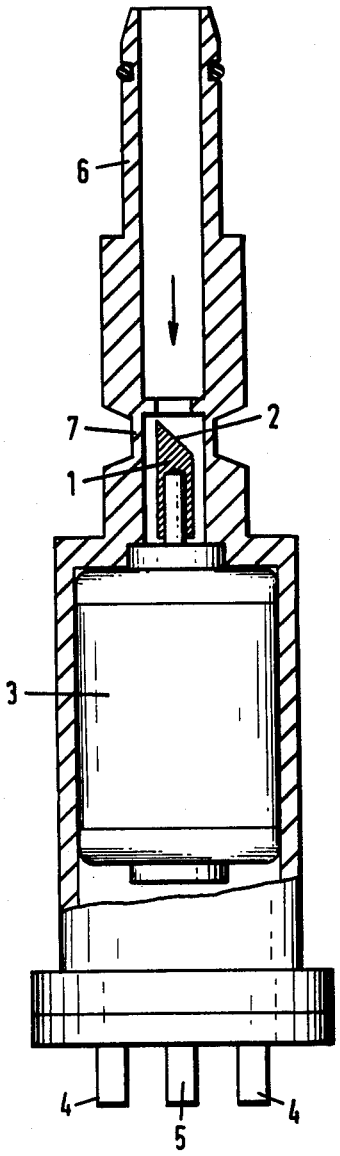
6
7
2
1
3
4
5
4

X-RAY TUBE

This invention relates to an X-ray tube comprising a cathode serving as a source of electron rays and a rotatable anode.

Such an X-ray tube is known in a form in which the rotatable anode is of conical or frustoconical shape. The electron ray is directed to the surface of the cone and, as the anode rotates, describes a circle on that surface, so that the heat generated by the electrons impinging on the anode is not concentrated on one place but is distributed over the points located on the circle. The resulting X-ray beam is deflected into a fixed direction.

X-ray tubes can be used for many purposes. One of these uses is the testing of a tube-to-tube weld connection by means of X-rays. For this purpose a film is applied around the outside of the weld connection and a source of X-rays is placed within the tube. For each picture of a portion of the weld connection the position of the X-ray source must be altered, which is a time-consuming operation.

It is an object of the present invention to provide an X-ray tube whereby the disadvantage of repeated alteration of the position of the X-ray tube is removed.

This object is realized, according to the invention, in that the anode is bevelled so that a rotating X-ray beam can be obtained by rotating the anode.

It is noted that there is a prior X-ray tube which comprises a stationary, pointed anode, and in which the electron ray is directed to the point of the anode. This anode may, for example, by of pyramidal or conical shape. With that X-ray tube a symmetrical X-ray distribution over a solid angle of more than 180° can be obtained.

One disadvantage of such an X-ray tube is, however, that the intensity of the radiation is not homogeneously distributed around the point, as it is not possible to focus the electron beam accurately enough for that purpose.

The X-ray tube according to the present invention can be constructed in various ways. The anode may have a fully bevelled target side, but a partially bevelled target side is possible. The only requirement is that the anode should be bevelled over at least a portion of the target side so that a rotating X-ray beam can be obtained when the anode is rotated.

The other structural specification of the subject X-ray tube need not differ from prior X-ray tubes, and may be readily selected by the skilled worker in the art to suit individual requirements. In connection with the formation of a rotating X-ray beam, however, the window, if one is provided, through which the X-ray beam can leave the tube, should be of circular form.

A preferred embodiment of the present invention will now be described, by way of example, with reference to the accompanying diagrammatic drawing, which illustrates a portion of an X-ray tube according to the present invention in part-sectional elevation.

Referring to the drawing, there is shown a portion of an X-ray tube 6 according to the present invention, comprising a rotatable anode 1. The anode has an inclined or bevelled target side 2. Rotation of the anode can be effected with an electric motor 3 having terminals 4 for connection to a source of current having an EMF of, for example, 12 V, and a terminal 5 for connection to a target plate ammeter. The window portion of the X-ray tube is designated by 7.

In operation, an electron beam moving in the direction of the arrow through the X-ray tube portion shown impinges upon the bevelled target side 2 of the anode 1, the anode being made, for example, of tungsten. As the anode is rotated by means of electric motor 3, the X-ray beam formed describes a circular movement and leaves the X-ray tube through the window portion 7.

I claim:

1. An X-ray tube comprising a cathode serving as a source of electron rays and a rotatable anode, characterized in that the anode is bevelled so that a rotating X-ray beam can be obtained by rotation of the anode.

* * * * *